United States Patent [19]

Salzer et al.

[11] 3,986,157

[45] Oct. 12, 1976

[54] ELECTRIC FUSE HAVING SUBSTANTIALLY PRISMATIC CASING

[75] Inventors: Erwin Salzer, Waban, Mass.; Delbert L. George, Salem, N.H.

[73] Assignee: The Chase-Shawmut Company, Newburyport, Mass.

[22] Filed: Oct. 16, 1975

[21] Appl. No.: 623,047

[52] U.S. Cl. ..... 337/186; 337/414

[51] Int. Cl.[2] ..... H01H 85/02

[58] Field of Search ..... 337/158, 159, 186, 187, 337/414, 415

[56] References Cited

UNITED STATES PATENTS

| | | | |
|---|---|---|---|
| 2,870,293 | 1/1959 | Edsall | 337/158 X |
| 3,813,627 | 5/1974 | Koch | 337/159 |
| 3,846,727 | 11/1974 | Harmon | 337/186 X |
| 3,911,385 | 10/1975 | Blewitt et al. | 337/186 X |

*Primary Examiner*—George Harris
*Attorney, Agent, or Firm*—Erwin Salzer

[57] ABSTRACT

An electric fuse having a casing which has a substantially prismatic outer surface rounded at the longitudinal edges thereof. The casing is a multiply glass cloth laminate including thermosetting resin and is formed by pultrusion.

6 Claims, 6 Drawing Figures

ELECTRIC FUSE HAVING SUBSTANTIALLY PRISMATIC CASING

BACKGROUND OF THE INVENTION

Two casing geometries have widely been accepted for electric low-voltage power fuses. As a general rule, fuse casings are formed by insulating tubing cylindrical at the inside and at the outside thereof and having uniform wall thickness. In some instances a substantially prismatic casing geometry is preferred. To be more specific, it is desired in such instances that the casing be bounded outwardly by four planar surfaces enclosing right angles and forming externally rounded edge regions of increased wall thickness. Such casings are closed by a pair of terminal plates affixed to them by a plurality, i.e. four fasteners. These fasteners have shanks which project through the terminal plates into the edge regions of increased wall thickness of the casing.

Either of the two aforementioned types of fuses has specific advantages and specific limitations. It is the principal object of this invention to provide fuses which combine advantages of the two aforementioned types of fuses and are not subject to the limitations of the last referred-to type.

One of the most serious limitations of the last referred-to type of fuses resides in the fact that it has not been possible, heretofore, to manufacture the casings thereof at non-prohibitive cost of materials other than ceramic materials, in particular synthetic-resin-glass-cloth laminates. It is, therefore, a specific object of this invention to overcome this limitation, i.e. to provide fuses of the last referred-to type having casings of a synthetic-resin-glass-cloth laminate.

Further objects and advantages of this invention will become apparent as this specification progresses.

SUMMARY OF THE INVENTION

Fuses embodying this invention include a tubular casing of electric insulating material housing a fusible element means and a granular arc-quenching filler. The casing is outwardly bounded by four substantially planar surfaces enclosing right angles and forming four externally rounded edge regions of increased wall thickness. A pair of terminal plates is arranged at the ends of the casing, closing the latter, and affixed by four fasteners to it. The terminal plates are conductively interconnected by the aforementioned fusible element means. The four fasteners for the pair of terminal plates are provided with shanks projecting into fastener-shank-receiving recesses provided in the four edge regions of the casing.

The above features are common to prior art fuses having casings of ceramic materials and fuses embodying this invention.

In fuses embodying the present invention the casing is a laminate formed by glass fiber reinforcement means and a cured synthetic resin. The aforementioned reinforcement means include an intermediate ply of non-woven glass fiber mat material having non-uniformly oriented fibers and an outermost ply and an innermost ply, both of woven glass fiber cloth. The outermost ply and the innermost ply sandwich the intermediate ply and both the outermost and the innermost ply form overlap regions coextensive with the length of the casing. The aforementioned overlap regions of said outermost ply and of said innermost ply are recessed in said mat material so that said casing has even external surfaces and even internal surfaces, i.e. external and internal surfaces which have no discontinuities. The casing further includes four bundles of glass fibers oriented substantially in a direction longitudinally of the casing, and each arranged along one of the four edge regions thereof. Each of the four bundles of glass fibers is sufficiently bulky to result in a substantial increase of the wall thickness of the casing at the four edge regions thereof. The four fastener-shank-receiving recesses are arranged in the regions of the casing occupied by said four bundles of glass fibers.

DESCRIPTION OF PREFERRED EMBODIMENTS

Figure 1:
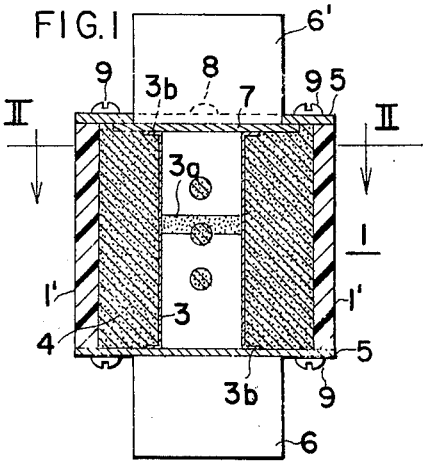
FIG. 1 is substantially a vertical section of a fuse embodying this invention taken along I—I of FIG. 2.

Referring now to the drawings, numeral 1 has been applied to generally indicate a tubular casing of electric insulating material. Casing 1 is outwardly bounded by four substantially planar surfaces 1' enclosing right angles and forming externally rounded edge regions 1'' of increased wall thickness. Casing 1 defines the cavity 2 which houses fusible element means 3 formed by a perforated channel-shaped ribbon of sheet metal and further houses the granular arc-quenching filler 4 in which fusible element means 3 is immersed. Filler 4 is preferably formed by quartz sand. Fusible element 3 is provided with an overlay **3*a* of a low fusing point metal for forming a break at the occurrence of protracted overloads. Casing 1 is closed on the ends thereof by terminal plates 5 conductively interconnected by fusible element means 3. To this end fusible element 3 is provided with tabs 3*b* of which the lower tabs are spot welded to lower plate 5 and the upper tabs are spot welded to plate 7. Plate 7 is arranged below upper plate 5 and affixed to, and conductively connected with, upper plate 5 by screws 8. The lower terminal plate 5 is provided with a first blade contact 6 forming an integral part thereof. The upper terminal plate 5 is provided with a blade contact 6'** forming an integral part thereof.

Reference numeral 9 has been applied to indicate a plurality of fasteners, e.g. four screws, for affixing terminal plates 5 to casing 1. Each fastener 9 includes a shank (not shown) arranged parallel to the longitudinal axis of casing 1 and projecting through terminal plates 5 into the edge regions 1'' of increased wall thickness of casing 1. Reference numeral 10 has been applied to indicate the four bores or recesses for receiving the shanks of the four fasteners or screws 9. Gaskets (not shown) of asbestos may be interposed between plates 5 and casing 1.

The structure described up to this point is, in essence, prior art, the gist of the present invention residing in the features of casing 1 described below.

Casing 1 is composed of laminated reinforcement means and of a cured thermosetting resin. The aforementioned reinforcement means include an outermost ply *a* and an innermost ply *b* both of woven glass fiber cloth. Each of both plies *a,b* forms an overlap region *a'* and *b'*, respectively, coextensive with the length of casing 1. The reinforcement means further include non-woven glass fiber mat material *c* having non-uniformly oriented fibers arranged between plies *a* and *b*. It will be understood that plies *a,b*, prior to impregnation thereof with synthetic resin, have a relatively small degree of compressibility, while the intermediate ply or plies of non-woven mat material *c* has a relatively high degree of compressibility. Ply or plies *c* may form one or more overlap regions in the same fashion as plies *a* and *b*. The reinforcement insert of casing 1 further includes four bundles *d* of substantially parallel glass fibers oriented in a direction substantially longitudinally of casing 1. Each of bundles *d* is arranged along one of the edge regions 1'' of casing 1 and sandwiched between woven glass cloth plies *a,b*. Each of the glass fiber bundles *d* is sufficiently bulky to result in a substantial increase of the wall thickness of casing 1 in the corner regions 1'' thereof.

The overlap regions *a',b'* of plies *a,b* are recessed in the relatively readily compressible mat material *c* so that casing 1 has even, i.e. continuous, external surfaces and even internal surfaces. In other words, the overlaps *a',b'* do not cause any noticable changes of the wall thickness of the casing 1 at the points where overlaps are located.

The four bundles *d* of glass fibers are preferably formed by glass fiber rovings. Rovings are made by gathering a plurality of continuous filament strands and winding them to form cylinder-like packages. Each strand consists of many monofilaments.

There are commercially available two types of rovings known as continuous rovings and spun rovings, respectively. Both types of rovings may be used to fill the edge regions 1'' of casing 1 and thus to impart an increased wall thickness to these regions. Spun roving is a bulkier roving including continuous filament strands looped back and forth and maintained in roving form by a combination of twisting and sizing. The sizing must be compatible with the resin used to impregnate the constituent plies *a,b,c* and rovings *d* of casing 1.

Figure 3:
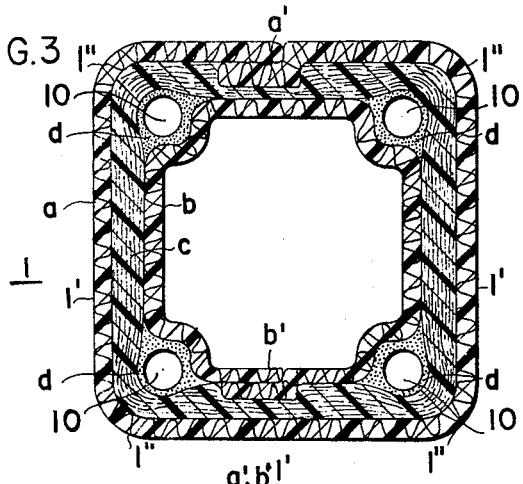
FIG. 3 is a section taken along II—II of FIG. 1 and is drawn on a larger scale than FIGS. 1 and 2 and shows but the casing of the fuse, deleting all other parts of which the fuse is made up.
Figure 4:
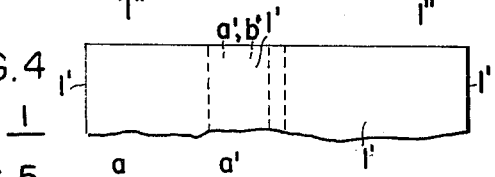
FIG. 4 is a side elevation of a portion of the casing of FIG. 3, the lower portion of the casing being broken away.
Figure 5:
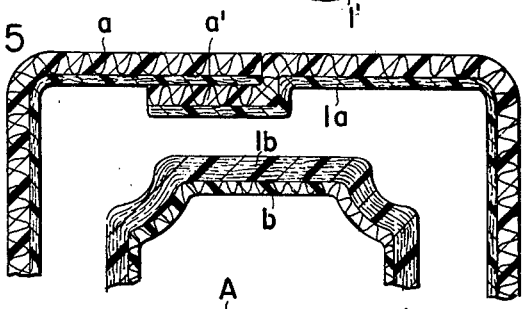
FIG. 5 is a cross-section of a modification of the structure of FIGS. 3 and 4 and shows but portions of the outermost ply and of the innermost ply, some of the other portions of these plies being broken away and the reinforcement means of the casing between said two plies being deleted.

The process of manufacturing casings as shown in FIGS. 3 and 4 by pultrusion may be facilitated by forming the outermost ply *a* and the innermost ply *b* of pairs of composite integral layers as shown in FIG. 5. Such composite integral layers include, in addition to a first layer *a* of woven glass fiber cloth a non-woven lining layer of mat material made up of irregularly oriented or random oriented glass fibers. Reference characters 1*a* and 1*b* have been applied in FIG. 5 to indicate these lining layers. Since the woven glass cloth layer *a* and its non-woven lining layer 1*a* form a unitary dual ply, the overlap *a'* is formed by both layers *a* and 1*a*. The woven glass cloth layer *b* and its non-woven lining layer 1*b* form also a unitary dual ply and, therefore, this results if the reinforcement material of FIG. 5 is used to form the casing of FIG. 3, in an overlap region *b'* wherein both the woven layer *b* and the non-woven layer 1*b* overlap. In FIG. 5 the intermediate layer *c* of FIG. 3 has been deleted to better show the concept of lining each of the relatively incompressible woven glass cloth layers *a,b* with a relatively compressible non-woven glass cloth material 1*a*,1*b* formed by irregularly oriented fibers.

The thickness of layers *a* and *b* does not need to be the same and this applies also in regard to lining layers 1*a* and 1*b*. As shown in FIG. 5, the thickness of lining layer 1*b* exceeds that of lining layer 1*a*.

Figure 6:
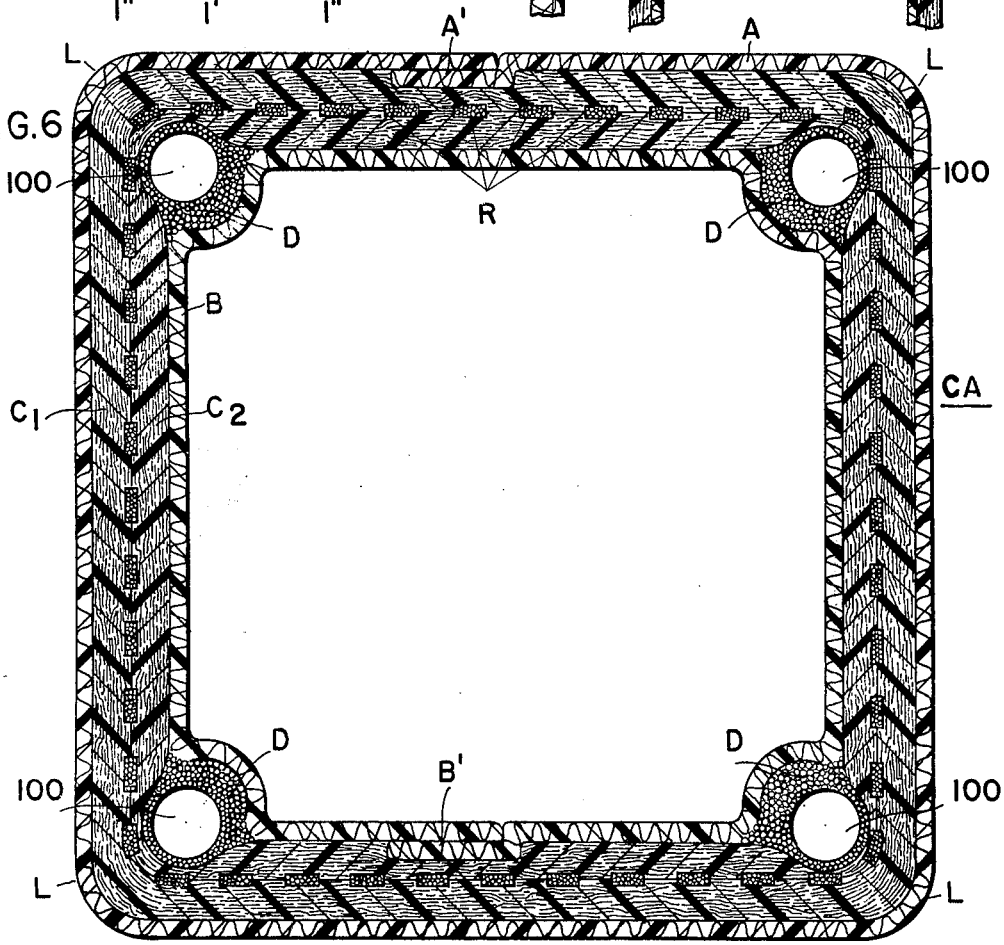
FIG. 6 is a modification of the casing section of FIG. 3 intended for applications requiring fuse casings of relatively large cross-sectional area and of relatively large dynamic bursting strength.

Referring now to FIG. 6, the structure shown therein is basically the same as that shown in FIGS. 3 and 4, but the structure of FIG. 6 includes a relatively larger number of reinforcement plies and is intended for casings having relatively large dimensions and/or requiring a particularly high dynamic bursting strength.

Figure 2:
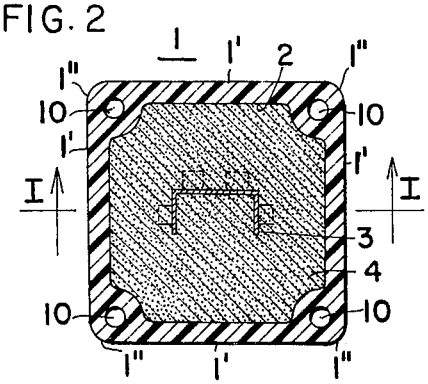
FIG. 2 is a cross-section taken along II—II of FIG. 1.

Referring to FIG. 6, reference character CA has been applied to indicate a casing composed of laminated reinforcement means and of a cured thermosetting resin. The reinforcement means include an outermost ply A and an innermost ply B, both of woven glass fiber cloth. Plies A and B form overlap regions A' and B', respectively, coextensive with the length of casing CA. The reinforcement means further include a first layer $C_1$ and a second layer $C_2$ of non-woven soft and compressible mat material made up of irregularly, or randomly oriented glass fibers. A further ply R of reinforcement material is interposed between plies $C_1$ and $C_2$. Ply R is made up of rovings spaced from each other in circumferential direction which jointly form a squirrel-cage-like structure. Ply R is arranged at the interface between plies $C_1$ and $C_2$ and the constituent rovings of ply R penetrate into plies $C_1$ and $C_2$ under the pressure exerted upon plies $C_1$ and $C_2$ when the various plies are moved through the dies of a pultrusion machine. The reinforcement means of casing CA further include four bundles D of substantially parallel glass fibers oriented in a direction substantially longitudinally of casing CA. The bundles D are sandwiched between plies $C_2$ and B and consequently between plies A and B. Each of bundles D is arranged along one of the four edge regions L and the bulk of bundles D results in a significant increase of the wall thickness of casing CA at these regions. One of the principal reasons for the presence of ply R is to impart to the composite casing insert A,B,$C_1$,$C_2$,R,D the tensile strength required to withstand the large longitudinal stresses to which that insert is subjected in a pultrusion machine. Reference character 100 has been applied in FIG. 6 to indicate bores intended to receive the shanks of the screws or fasteners 9 of FIG. 1. The bores 100 of FIG. 6 correspond to the bores 10 of FIGS. 2 and 3.

The co-pending patent application of Daniel P. Healey, filed May 22, 1975, Ser. No. 579,972 for ELECTRIC FUSE HAVING A MULTIPLY CASING OF SYNTHETIC RESIN-GLASS-CLOTH LAMINATE discloses how a conventional pultrusion machine can be adapted for the production of fuse casings of a synthetic-resin-glass-cloth laminate having a high dynamic bursting strength. Substantially the same set-up as disclosed in the above referred-to patent application of Daniel P. Healey may be used for purposes of the present invention. All that is needed is the addition of four supply drums for the bundles of rovings *d* and D, respectively, of four guides for guiding these bundles of rovings *d*,D from their supply drums to the pultrusion machine proper and adaptation of the die of the pultrusion machine to the geometrical configuration of the outer and inner surfaces of the fuse casing 1 and CD as shown in FIGS. 3 and 6.

Ordinary screws do not lend themselves very well to affixing plates 5 to casing 1 and CA, respectively, and this is also true, to some extent, as to screws designed to be applied in conjunction with synthetic resins. It is necessary to apply fasteners for affixing parts 5 to parts 1 and CA which minimize splitting of the bundles *d* and D, respectively, by the shanks of the fasteners. Suitable fasteners for the purpose in hand are, for instance, fasteners having barbs on the shanks thereof, e.g. fasteners known by their trademark DRIV-LOK manufactured by the DRIV-LOK Inc.

It will be understood that ply *c* (FIG. 3) and plies $C_1$ and $C_2$ are no longer relatively compressible after having been impregnated in a pultrusion machine with a cured synthetic resin. In the completed casing 1 (FIG. 3) the ratio of glass fibers to synthetic resin is generally larger in plies *a* and *b* than in ply *c*. In like fashion, in the completed casing CA (FIG. 6) the ratio of glass fibers to synthetic resin is generally larger in plies A and B than in plies $C_1$ and $C_2$.

We claim as our invention:

1. An electric fuse comprising a. fusible element means;

b. a granular arc-quenching filler embedding said fusible element means;

c. a tubular casing of electric insulating material housing said fusible element means and said filler, said casing being outwardly bounded by four substantially planar surfaces enclosing right angles and forming four externally rounded edge regions of increased wall thickness;

d. a pair of terminal plates conductively interconnected by said fusible element means, arranged at the ends of said casing and closing said casing;

e. four fasteners projecting through said pair of terminal plates into four fastener-shank-receiving recesses provided in said four edge regions of said casing;

f. said casing being a laminate formed by glass fiber reinforcement means and a cured synthetic resin;

g. said glass fiber reinforcement means including an intermediate ply of non-woven glass fiber mat material having non-uniformly oriented fibers and said glass fiber reinforcement means further including an outermost ply and an innermost ply both of woven glass fiber cloth sandwiching said intermediate ply, said outermost ply and said innermost ply forming overlap regions coextensive with the length of said casing and recessed in said intermediate ply so that said casing has an even external surface and an even internal surface;

h. four bundles of substantially parallel glass fibers oriented substantially in a direction longitudinally of said casing, each arranged in one of said four edge regions thereof between said outermost ply and said innermost ply and each being sufficiently bulky to result in a substantial increase of the wall thickness of said casing at said four edge regions thereof; and i. said four fastener-shank-receiving recesses being arranged in the regions of said casing occupied by said four bundles of glass fibers.

2. An electric fuse as specified in claim 1 wherein said four bundles of glass fibers are formed by glass fiber rovings.

3. An electric fuse as specified in claim 2 wherein said rovings are spun rovings.

4. An electric fuse as specified in claim 1 wherein said outermost ply and said innermost ply are each lined with a coextensive layer of glass fiber material having non-uniformly oriented fibers and forming overlap regions coextensive with said overlap regions of said outermost ply and of said innermost ply.

5. An electric fuse as specified in claim 1 wherein a ply of spaced rovings arranged in squirrel-cage-like geometry is sandwiched between said outermost ply and said innermost ply.

6. An electric fuse as specified 65 in claim 5 wherein said ply of spaced rovings is arranged outwardly relative to said four bundles of glass fibers. fuel

* * * * *